US006536970B2

(12) United States Patent
Hauser et al.

(10) Patent No.: US 6,536,970 B2
(45) Date of Patent: Mar. 25, 2003

(54) LOTION APPLICATOR

(76) Inventors: Lloyd A. Hauser, 28007 Sand Canyon Rd., Canyon Country, CA (US) 91351-3646; Lance A. Hauser, 28007 Sand Canyon Rd., Canyon Country, CA (US) 91351-3646

( * ) Notice: Subject to any disclaimer, the term of this patent is extended or adjusted under 35 U.S.C. 154(b) by 0 days.

(21) Appl. No.: 10/032,409

(22) Filed: Dec. 31, 2001

(65) Prior Publication Data

US 2002/0172540 A1 Nov. 21, 2002

Related U.S. Application Data

(60) Provisional application No. 60/292,278, filed on May 21, 2001.

(51) Int. Cl.[7] ..... A45D 34/00
(52) U.S. Cl. ..... 401/6; 401/186; 401/205
(58) Field of Search ..... 401/6, 186, 185, 401/205

(56) References Cited

U.S. PATENT DOCUMENTS 4,961,661 A * 10/1990 Sutton et al. ..... 401/6
5,240,339 A * 8/1993 DeForest et al. ..... 401/6 X
6,126,352 A * 10/2000 Wiley ..... 401/6 X
6,129,469 A * 10/2000 Messer et al. ..... 401/6
6,261,014 B1 * 7/2001 Altobellis et al. ..... 401/6
6,412,997 B2 * 7/2002 Berke et al. ..... 401/6

* cited by examiner

*Primary Examiner*—Gregory L. Huson
*Assistant Examiner*—Kathleen J. Prunner
(74) *Attorney, Agent, or Firm*—Roger A. Marrs

(57) ABSTRACT

A lotion applicator having a flexible container holding a quantity of lotion which terminates at one end in a threaded neck for threadably receiving a discharge nozzle conducting lotion or the like through the neck. The discharge member includes an aperture projection adapted to insertably pass through an opening in a closure cap, so as to permit the discharged lotion to exit the container and the cap. The discharge projection has a closed position when inserted through the opening in the cap and a discharge position within the cap, so as to permit the lotion to exit the discharge member and pass through the unoccupied aperture in the cap for flow into an elongated applicator arm. The arm includes a threaded coupling for engaging with the discharge cap and extends outwardly from the container in a cantilevered manner to terminate in an application member having a plurality of openings in communication with an elongated passageway extending from the discharge cap through the arm to the applicator member. An exterior surface of the applicator member may include skin massaging nubs which will assist in the spread of the lotion when conducted from the applicator member.

10 Claims, 5 Drawing Sheets

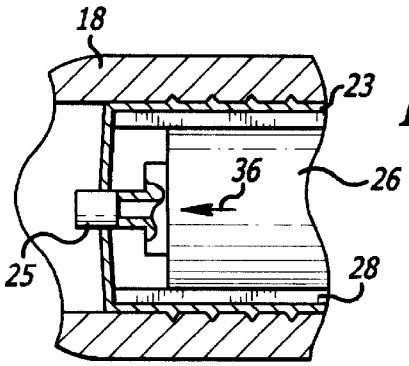
FIG. 4
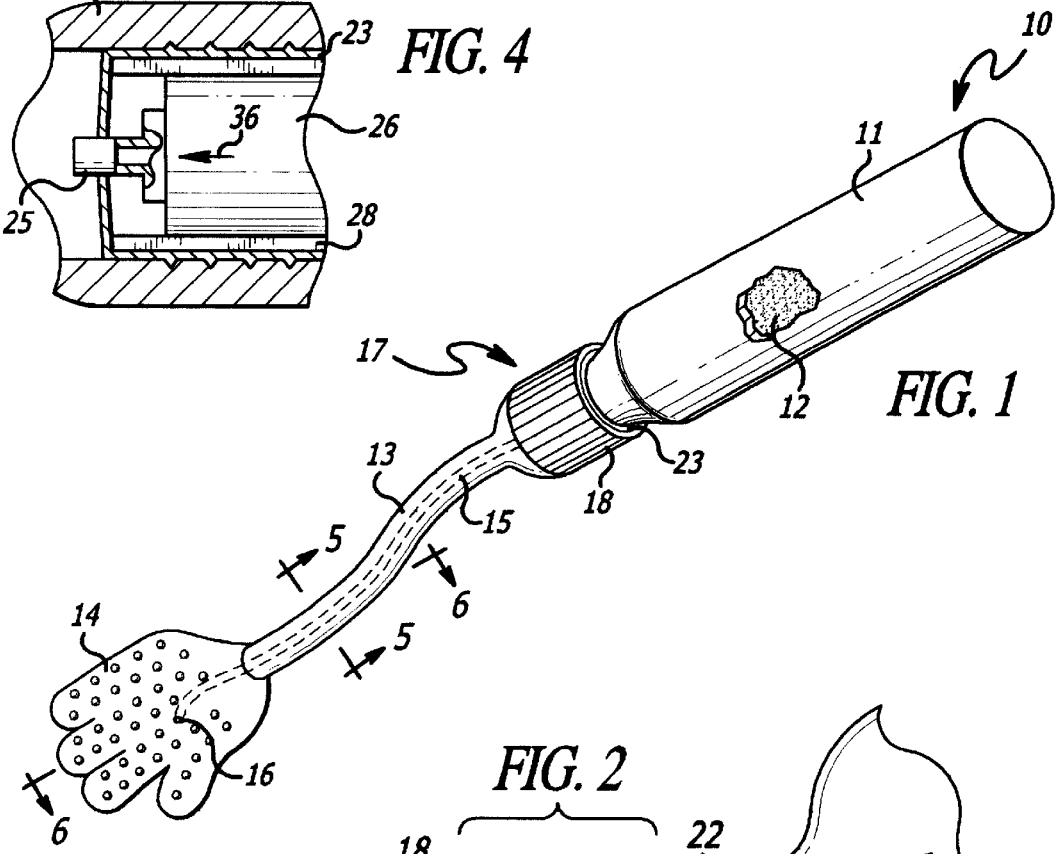
FIG. 1
FIG. 2
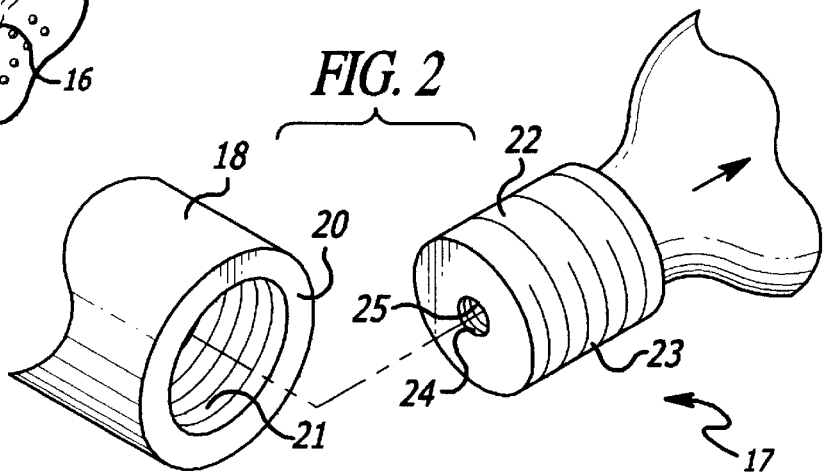
FIG. 3
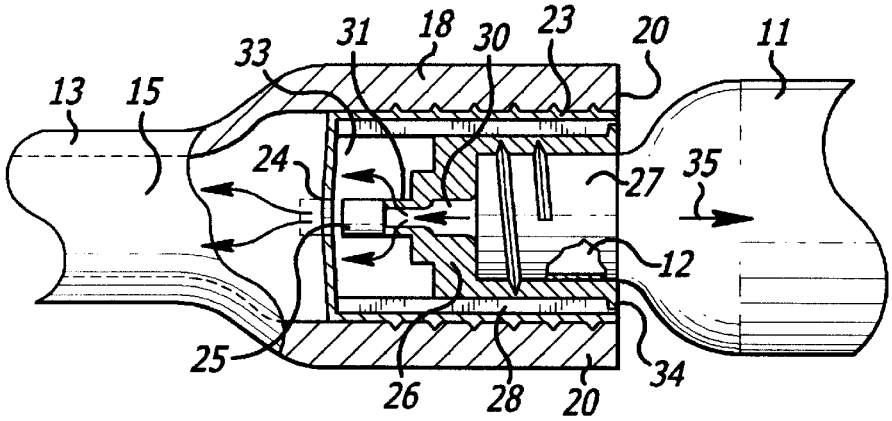

FIG. 6
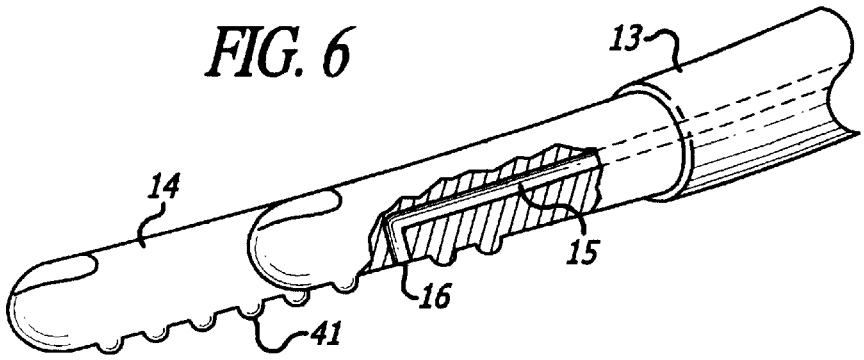
FIG. 7
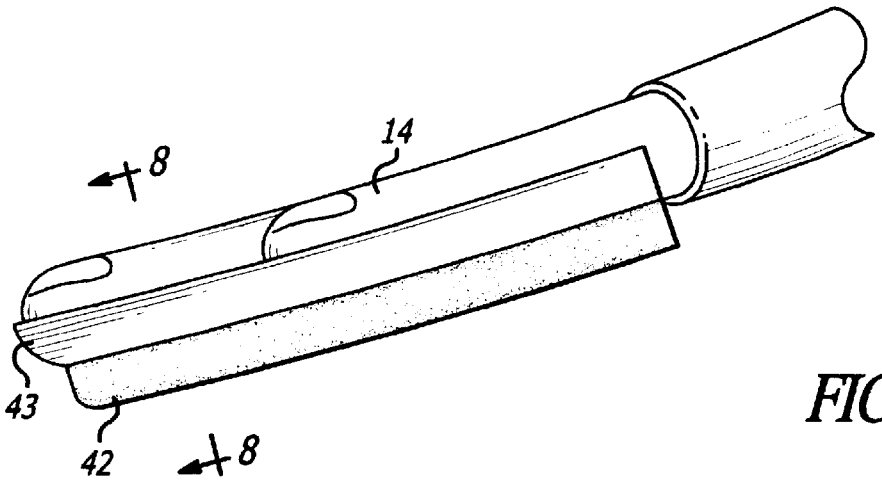
FIG. 8
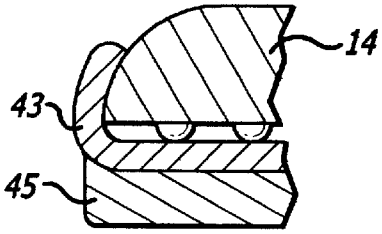
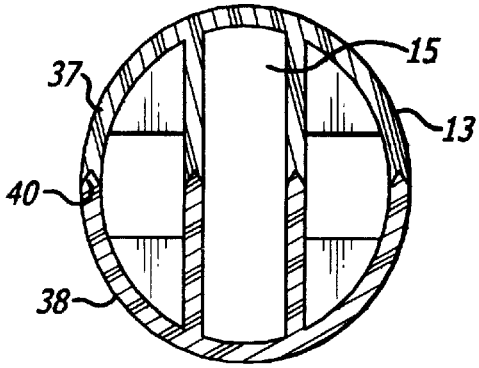
FIG. 5

10
50
51
16
14
10
52
53
13
17
11
54
52
14

50
51
14

FIG. 16A
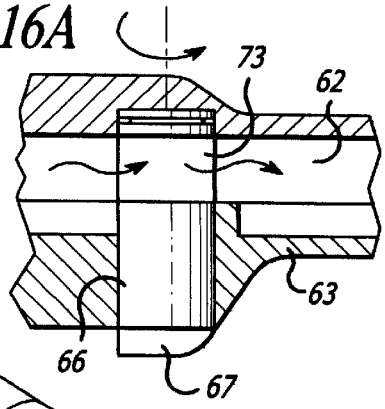
FIG. 16B
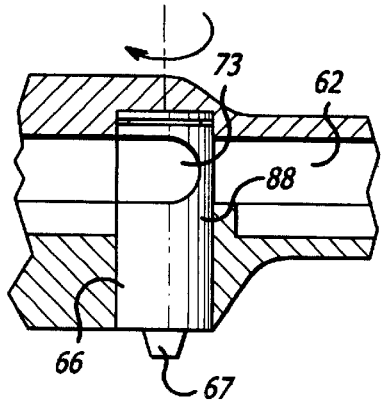
FIG. 12
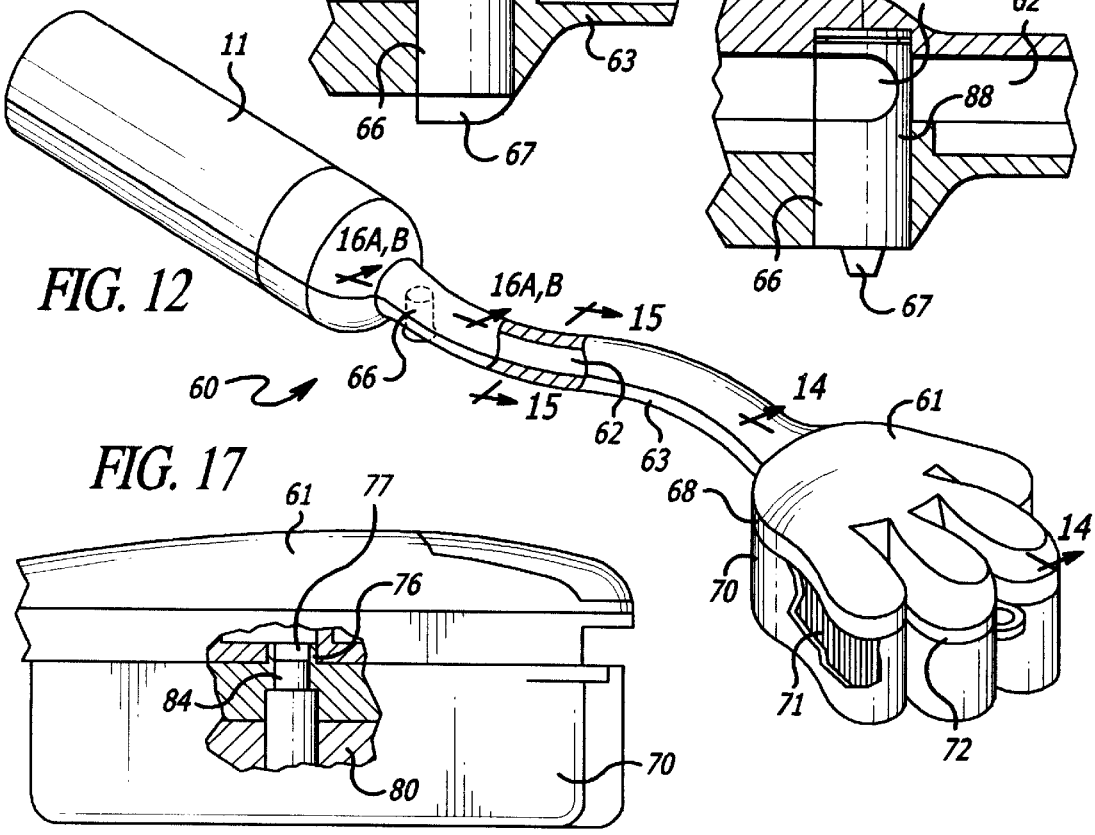
FIG. 17
FIG. 14
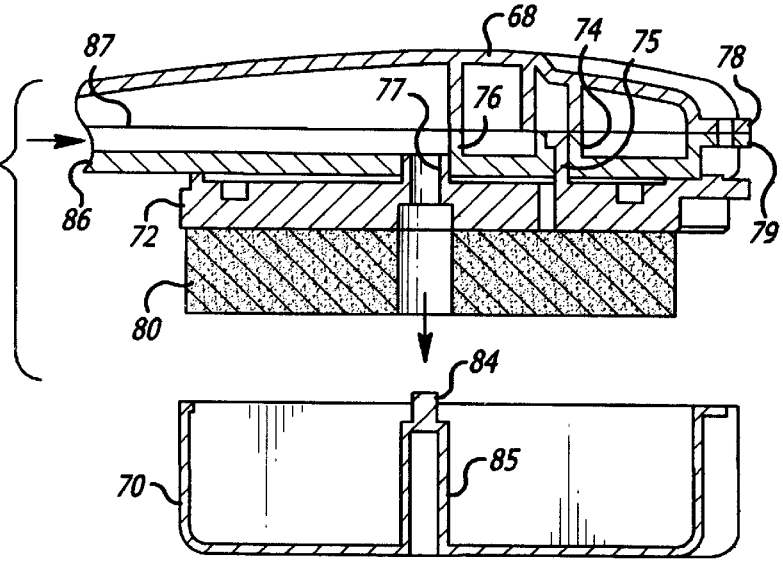
FIG. 15
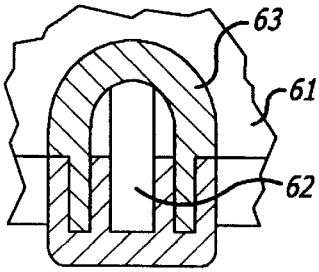

LOTION APPLICATOR

Priority claimed on Ser. No. 60/292,275 filed May 21, 2001.

BACKGROUND OF THE INVENTION

1. Field of the Invention

The present invention relates to the field of applicators for dispensing liquid or semi-liquid products such as lotions and, more particularly to a novel lotion dispenser attached to one end of an elongated arm which terminates in an applicator for discharging lotion onto the skin of the user.

2. Brief Description of the Prior Art

In the past, it has been the conventional practice to apply a lotion to the skin of the body by the user applying or dispensing the lotion into the palm of his or her hand, followed by manually applying the lotion to the desired skin areas. Problems and difficulties have been encountered with such a procedure which stems largely from the fact that the user cannot readily reach various parts of the body such as the middle of the back or shoulders so that the lotion is not evenly applied or is not applied at all.

Some attempts have been made to solve this problem by employing an extension onto the lotion dispenser which permits the user to extend his reach for lotion application. In such prior instances, the arm is straight or linear and does not permit manual manipulation in order to reach the more difficult skin areas.

Still a further problem is present because most extension arms are not adapted to fit conventionally manufactured lotion bottles or dispensers so that the extension arm can only be used with a particular designed and manufactured bottle or dispenser. In other words, the application arm is not adapted to fit standardized lotion dispensing bottles or containers.

Therefore, a long-standing need has existed to provide a lotion applicator which includes a dispensing bottle with a standardized top or neck to which is attached an applicator arm for conducting the lotion from the container to the skin of the user. The fitting of the applicator arm should be such that it will readily accept the neck of the standardized bottle or dispenser and attachment should be made so that there is no leakage when the lotion is conducted under pressure from the container to the applicator arm.

SUMMARY OF THE INVENTION

Accordingly, the lotion applicator of the present invention solves the above problems and difficulties by providing a flexible container for holding a quantity of liquid or semi-liquid material such as skin lotion, soap or the like wherein the container terminates at one end in a threaded neck adapted to threadably receive a discharge nozzle for conducting the lotion or the like from the container through the neck. The discharge member includes an aperture projection adapted to insertably pass through an opening in a closure cap so as to permit the discharged lotion or the like to exit the container and the cap. The discharge projection has a closed position when inserted through the opening in the cap and a discharge position within the cap so as to permit the lotion to exit the discharge member and pass through the unoccupied aperture in the cap for flow into an elongated applicator arm. The arm includes a threaded coupling for engaging with the discharge cap and extends outwardly from the container in a cantilevered manner to terminate in a application member having a perimeter configuration representing a human hand. The applicator member includes a plurality of openings which are in communication with an elongated passageway extending from the discharge cap through the arm to the applicator member. An exterior surface of the applicator member may include skin massaging nubs which will assist in the spread of the lotion when conducted from the applicator member.

It is also envisioned that the applicator member may include means for detachably connecting a variety of accessories to the applicator member such as a brush, a sponge, or other skin conditioning device.

Therefore, it is among the primary objects of the present invention to provide a novel lotion applicator whereby the user may readily apply lotion to difficult to reach skin areas and whereby the lotion may be discharged from a container by squeezing the container forcing the lotion into a lotion applicator member.

Another object of the present invention is to provide a novel applicator for a liquid or semi-liquid material that is pressurized by means of a squeeze bottle or container so that the material is discharged through an elongated arm manually manipulated by the user so as to reach difficult to reach areas of a person's torso.

Still a further object resides in providing a applicator for a lotion which is readily connectable to the nozzle end of a conventional container or squeeze bottle holding a quantity of lotion.

Still another object resides in providing a novel lotion applicator which is useful in helping a person apply lotion to hard-to-reach areas of their body such as the back and shoulder areas.

A further object resides in providing an applicator for a lotion or the like which assists the person to wash their body while in the shower or bath.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view illustrating the novel lotion applicator incorporating the present invention;

FIG. 2 is an exploded perspective view, greatly enlarged, illustrating the detachable connection between the lotion applying arm and the neck of a bottle containing a supply of lotion;

FIG. 3 is a fragmentary, cross-sectional view of the coupling means between the lotion applying arm and the neck of the supply container or bottle;

FIG. 4 is a view, similar to the view of FIG. 3, illustrating the coupling means in a closed condition restricting the flow of lotion from the container into the applicator arm;

FIG. 5 is a greatly enlarged transverse, cross-sectional view of the applicator arm illustrated in FIG. 1 as taken in the direction of arrows 5—5 thereof;

FIG. 6 is a greatly enlarged sectional view of the applicator member for discharging lotion carried on the end of the applicator arm taken in the direction of arrows 6—6 of FIG. 1;

FIG. 7 is a side elevational view of the lotion applicator member having a detachable brush assembly carried thereon;

FIG. 8 is a sectional view taken in the direction of arrows 8—8 of FIG. 7;

FIG. 12 is another version of the present invention of a lotion applicator;

FIG. 14 is an enlarged, exploded, cross-sectional view of the applicator member employed in the lotion applicator of FIGS. 12 and 13;

FIG. 15 is a transverse, cross-sectional view of the extension arm as taken in the direction of arrows 15—15 of FIG. 12;

FIGS. 16A and 16B are transverse, cross-sectional views of a closure gate or valve illustrated in an open and a closed position respectively as shown in FIG. 12 in the direction of arrows 16A,B—16A,B: and FIG. 17 is a side elevational view, partly in section, of the applicator member shown in FIG. 14.

DESCRIPTION OF PREFERRED EMBODIMENT

Figures 9, 10, 11:
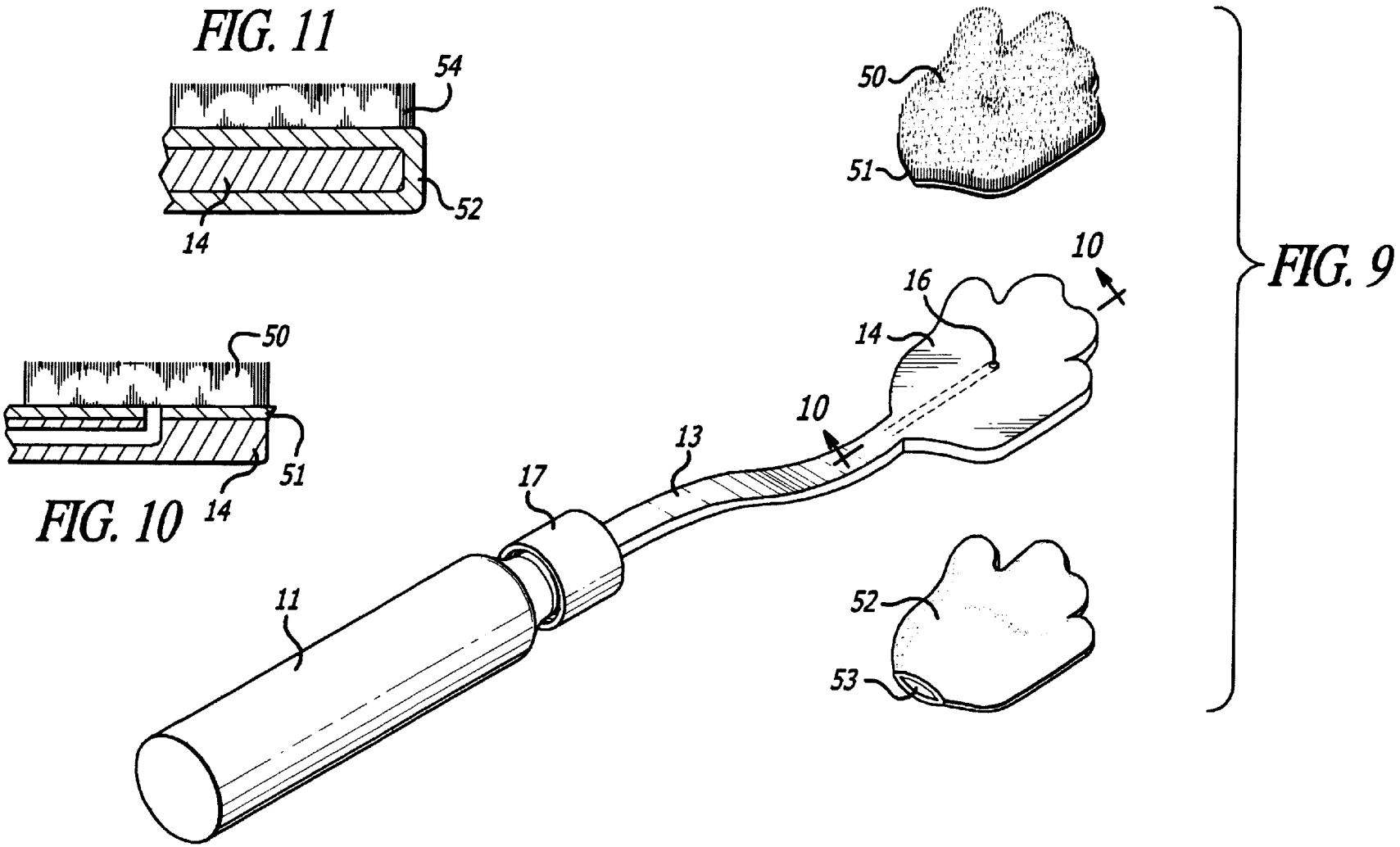
FIG. 9 is a perspective view illustrating another version of the invention wherein various accessories, such as sponges, brushes or the like, may be added to the applicator member.
FIG. 10 is a fragmentary view of the applicator member and brush accessory taken in the direction of arrows 10—10 of FIG. 9.
FIG. 11 is a fragmentary, sectional view illustrating a glove accessory for insertably receiving the applicator member on the end of the arm.

Referring to FIG. 1, the novel lotion applicator incorporating the present invention is illustrated in the general direction of arrow 10 which includes a squeeze bottle or container 11 holding a quantity of lotion 12 intended to be applied to the body of the user. Application of the lotion 12 is via an applicator arm 13 having an applicator member 14 carried on the terminating end of the arm. A continuous passage-way 15 extends from a socket end 18 of the arm 13 communicating with the bottle or container 11 to the applicator member 14 for ultimate discharge through at least one opening such as opening or discharge orifice 16. The end of arm 13, opposite from its end carrying its applicator member 14, is provided with a coupling means 17 for joining with the squeeze bottle 11. The coupling means includes a socket 18 having an internally threaded bore 21 for locatably receiving external threads 22 carried on a cap 23.

FIG. 2 clearly shows the attachment or coupling means 17 and further illustrates that the end of cap 23 includes an opening 24 through which a projection 25 is passed that is carried on the end of an insert 26 as shown in FIG. 3. FIG. 2 also illustrates that the squeeze bottle container 11 includes a neck 27 having external threads which are engageable with a threaded bore provided on the insert 26. It can also be seen that the cap 23 includes inwardly projecting ribs, such as rib 28, which are alternatively disposed in spaces with respect to ribs provided on the external surface of the insert 26. Such an arrangement of ribs prevents rotation of the insert with respect to the cap 23 while permitting rectilinear movement of the insert through the bore of the cap.

As illustrated in FIG. 3, the insert 26 is illustrated in its open position, whereby lotion 12 can proceed through insert passageway 30 for discharge through apertures such as aperture 31 in the projection 25. The lotion will proceed from the aperture 31 into an intermediate chamber 33 and then through the port or opening 24 in the end of cap 23. In order to close the opening 24 when it is not desired to dispense the lotion 12, the insert 26 is moved forward so that projection 25 passes through and occupies opening 24. No further discharge of lotion can proceed into passageway 15 of the arm leading to the dispensing member 14. Movement of the insert 26 through the cap 23 is stopped when the projection 25 occupies opening 24, as shown in broken lines, when a flange 34 carried on the end of the insert engages with the bottom of the ribs 28. To open the port 24 to permit flow of lotion into passageway 15, the insert is moved in the direction of arrow 35 by pulling back on the bottle 11. In the open position, the insert is shown in solid lines.

Referring now in detail to FIG. 4, the applicator is shown in its closed position when the insert 26 is moved in the direction of arrow 36. Thus, the projection 25 fully occupies the port or opening 24 in the end of cap 23. The flow of lotion is thus blocked and no lotion can enter passageway 15 in the arm 13.

Referring in detail to FIG. 5, a cross-section of the arm 13 is illustrated so as to show that the construction is lightened by incorporating of spaces within the arm. The passageway 15 is employed to conduct the lotion from the container or squeeze bottle 11 to the applicator member 14. It can also be seen that the arm may be molded into two pieces as represented by numerals 37 and 38 which are subsequently joined together at a V-shaped joint 40.

In FIG. 6, it can be seen that the passageway 15 is reduced in the application member 14 and that the lotion is then discharged through aperture 16. A plurality of massaging nodes such as indicated by numeral 41 may be included along the exterior surface adjacent to the discharge orifice 16.

In FIG. 7, the applicator member 14 may accommodate the detachable mounting of a brush. The brush is indicated by numeral 42 and may be carried on the underside of a shoe 43 which is snapped onto the underside of the applicator member 14. Lotion from the discharge orifice 16 is introduced into the brushes 42, if desired.

FIG. 8 clearly shows that the shoe 43 may be form-fitted around the end of the perimeter of the lotion applicator 14 for detachable connection therewith. The brushes 42 may also take the form of a foam or massage pad 45.

Referring now in detail to FIG. 9, another embodiment of the invention is illustrated wherein lotion from the squeeze bottle 11 may be conducted through curved or shaped arm 13 for discharge through discharge orifice 16 in the applicator 14. An internal passageway 15 carries the lotion from the bottle 11 through the coupling means 17 and the arm 13 to the applicator member 14. However, it is to be understood that the applicator member may include a brush 50 which is carried on a base 51 that is releasably attached to the upper surface of the lotion applicator member 14 immediately adjacent to the discharge orifice 16. Attachment may be made by a releasable adhesive, or any other mechanism. The brush 50 is shown more clearly in FIG. 10 wherein the base 51 is attached to the surface of member 14 by any suitable means.

Referring now to FIGS. 9 and 11, another alternative usage is contemplated in which a glove member 52 may be carried on the end of the arm 13 by inserting applicator member 14 through a entrance or opening 53. The surface of the glove 52 may carry bristles or any other type of massaging devices as indicated by numeral 52.

In view of the foregoing, it can be seen that the lotion applicator of the present invention provides a convenient means for applying lotion to hard-to-reach areas of the body. The arm 13 is curved so as to accommodate ease in manipulation of the applicator to desired locations. The squeeze bottle 11 may readily be removed by disconnecting the arm by means of the coupling means 17. Therefore, replacement of a new bottle with lotion can be readily attached. A plurality of accessories, such as brushes, sponges, massage pads or the like, can be carried on the applicator member 14 and lotion can be applied simultaneously or withheld at the desire of the user.

Figure 13:
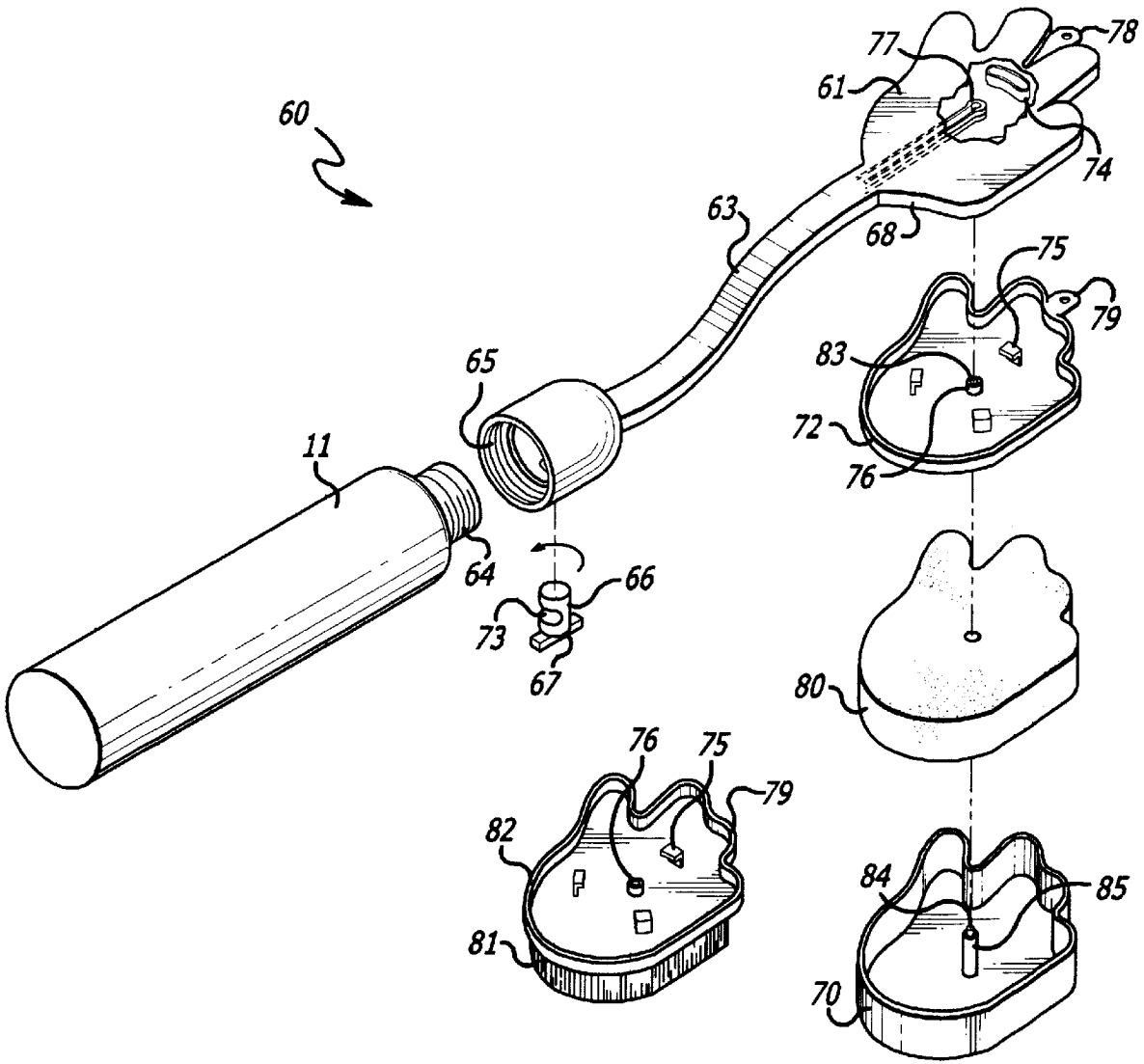
FIG. 13 is an exploded perspective view of the lotion applicator shown in FIG. 12.

Referring to FIGS. 12 and 13, an alternative embodiment of the present invention is illustrated in the general direction of arrow 60 wherein the contents of container 11 is supplied to an applicator member 61 via an internal passageway 62 provided in extension arm 63. The applicator member 61 is integrally formed at one end of the arm while the opposite end of the arm is attached to the end of container 11 by means of a threaded nozzle 64 engaging with the threads of socket 65. It can be seen that the contents of container 11 is supplied to the passageway 52 past a valve 66 which has two positions. In the first position, the valve operates as a gate to close the passageway 62 preventing contents from passing through the passageway. In the second position, the valve operates as a gate opening the passageway to permit contents to be introduced to the applicator member 61.

It can be seen that the applicator member includes a top or upper portion 68 to which a cover 70 is attached in a snap-lock relationship therewith. The cover 70 includes a cavity occupied by a spreading element for the lotion or contents delivered from container 11 which may take the form of a brush, sponge, or the like and is identified in general by numeral 71. The applicator member 61 further includes a lower portion or section 72 which is detachably connected to the underside of the top or upper section 61 by snap-lock means or the like. Referring now in detail to FIG. 13, it can be seen that the attachment of nozzle 64 to the socket 65 may take the form of the structure illustrated in FIG. 3 or may be directly connected by threadable coupling. If the structure of FIG. 3 is employed, the stop mechanism for the flow of contents from container 11 is identical to that shown in FIG. 3; however, by the use of the valve or gate 66, the same effect can be achieved for controlling the flow of contents from container 11. The valve 66 includes a cut-out in one side identified by numeral 73 while a manual turning projection 67 is integrally formed therewith so that the projection can be gripped by the hand of the user and rotated between the open and the closed positions previously described.

It can be seen that the applicator member 61 includes several receptacles, such as receptacle 74, for receiving a indexed or registered clip, such as clip 75, carried on the lower member or section 72. Also, the lower section 72 includes a nub having an internal passageway and the nub is identified by numeral 76. The nub 76 is insertably aligned and inserted into a receptacle 77 carried on the top or upper section 68. Further securement is releasably achieved by means of a tab detentes, represented by numerals 78 and 79, carried respectively on the upper section 68 and the lower section 72.

Once the lower section 72 has been attached to the upper or top section 68, the user has a choice of placing either a sponge 80 onto the applicator member or a brush 81. If the brush is employed, an alternative lower member 82 is used having the same detentes or clips 78, 79 and nub 76. The sponge 80 may be secured to the underside of the lower member or section 72 by any suitable means. In either event, whether the sponge or brush is selected, the cover 70 may be used to cover either the sponge or brush when not in use. The cover also serves to provide a closure so that contents in the passageway 62 will not be transferred through the opening 83 in the nub 76. This is achieved by means of a plug 84 carried on the end of a post 85 which upperwardly projects from the bottom of the cover 70. The post can project through the sponge 80 if the sponge remains in position on the underside of the lower section 72, or the plug 84 can penetrate through the opening 83 in the nub 76 to close the receptacle 77 connected with passageway 63. In a similar fashion, the brush or sponge can be cleaned separately and the cover 70 can be applied to the lower section 72 with the plug 84 within the receptacle 77 for closure.

Referring now in detail to FIG. 14, it can be seen that when the lotion or contents of container 11 is provided via passageway 62 to the applicator member 61, the lotion is forced through opening 77 for discharge through the applicator member onto the body of the user. When the attachment 72 is employed carrying the sponge 80, the fluid is saturated in the sponge preparatory for applying to the skin of the user. However, when the brush 81 is employed with member 82 in place of member 72, then the lotion is applied through the opening 77 into the bristles of the brush. The passageway is open and complete when the cover 70 has been removed as shown in FIG. 14. In this instance, the passageway 77 is open since the plug 84 has been removed. However, in FIG. 17, the plug 84 occupies the receptacle or opening 77 so that no flow can take place when the cover 17 has been installed. FIG. 14 also illustrates that the applicator member 61 not only includes the upper portion 68 but this portion may have an under portion 86 to which the member 72 is attached via the clips 75 projecting into the receptacle 74. A parking line is indicated by numeral 87.

Referring now in detail to FIG. 15, it can be seen that the arm 63 includes the open-ended passageway 62 so that the contents from the container 11 may pass through the arm.

In FIG. 16A, the valve gate 66 is illustrated as being positioned via nub projection 67 into an open position so that fluid flow of the lotion or other material from container 11 will pass into the arm 63 via passageway 62. The notch or opening 73 is in alignment to permit flow to pass the valve. However, in FIG. 16B, the valve 66 is in its closed position wherein the notch or passageway 73 is transverse to the passageway 62. Therefore, a blockage occurs by means of body section 88 of the valve 66.

In view of the foregoing, it can be seen that the present invention provides a novel construction for conducting lotion or the like from the container 11 to the applicator 61 as shown in FIGS. 12–17 and to the applicator member 14 as shown in FIGS. 1–11. The user has the option of releasably attaching a brush, a sponge or other body massaging device, to the applicator member and the lotion will freely flow when the valves are open into brushes, sponges or the like. Preferably, the arm of each embodiment of the invention is curved in such a manner that the container 11 becomes a handle and the applicator member becomes the discharge means for the lotion. The applicator member may take the form of a hand, or other graphic representations; however, the configuration of the hand is preferred.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A lotion applicator comprising:

a container holding a quantity of lotion for dispensing onto the skin of a user;

an applicator member having an aperture for discharging lotion;

an elongated arm having an internal open-ended passageway interconnecting said container with said applicator member for conducting lotion from said container to said applicator member;

valve means disposed in said internal passageway having a closed position for blocking flow of lotion and an open position for conducting flow of lotion;

said arm being curved and non-linear whereby said applicator member is offset from alignment with said container; and said container serving as a handle with said arm and said applicator member cantilevered outwardly therefrom.

2. The lotion applicator defined in claim 1 including:

a detachable coupling connecting said container with said arm;

said valve means disposed in said coupling; and manual operating means carried on said valve means for moving said valve means between said closed position and said open position.

3. The lotion applicator defined in claim 2 including:

said quantity of lotion characterized as being pressurized by manual squeezing of said container to forcibly urge lotion into said internal open ended passageway.

4. The lotion applicator defined in claim 3 including:

a skin engaging member selected from a) brush and b) sponge carried on an attachment plate detachably engageable with said applicator member.

5. The lotion applicator defined in claim 3 including:

said applicator member having a selected surface provided with a multiplicity of massaging nubs.

6. A lotion applicator comprising:

a squeeze container for holding a quantity of lotion in a pressurized condition preparatory for manual discharge;

an applicator member having an aperture for receiving and discharging lotion in response to squeezing of said container;

said applicator member having an upper section and a lower section downwardly projecting from said upper section;

a skin engaging portion detachably coupled with said lower section; and a cover removably carried on said skin engaging portion.

7. The lotion applicator defined in claim 6 wherein:

said lower section includes receptacles;

said skin engaging portion includes clips insertably receivable into said receptacles for effecting a detachable connection therewith.

8. The lotion applicator defined in claim 7 wherein:

said applicator member includes a peripheral edge marginal region having a shape representing a human hand with at least three projections representing fingers and a fourth projection representing a thumb.

9. The lotion applicator defined in claim 8 including:

a set of body conditioning attachments detachably connectable to said applicator member;

said set includes:

a. a brush
b. a sponge
c. a massage unit.

10. The lotion applicator defined in claim 9 wherein:

said valve means is operably mounted on said coupling for manual operation between said open and said closed positions.

* * * * *